US011821125B2

(12) United States Patent
Lee

(10) Patent No.: US 11,821,125 B2
(45) Date of Patent: Nov. 21, 2023

(54) LAUNDRY TREATING APPARATUS AND SANITATION MANAGING METHOD FOR LAUNDRY USING THE SAME

(71) Applicant: LG ELECTRONICS INC., Seoul (KR)

(72) Inventor: Phaljin Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 728 days.

(21) Appl. No.: 16/993,805

(22) Filed: Aug. 14, 2020

(65) Prior Publication Data

US 2021/0087733 A1 Mar. 25, 2021

(30) Foreign Application Priority Data

Sep. 23, 2019 (KR) ..... 10-2019-0116982

(51) Int. Cl.

| | |
|---|---|
| ***D06F 33/30*** | (2020.01) |
| ***D06F 34/18*** | (2020.01) |
| ***D06F 34/28*** | (2020.01) |
| ***D06F 34/14*** | (2020.01) |
| *D06F 105/60* | (2020.01) |
| *D06F 103/34* | (2020.01) |
| *D06F 103/32* | (2020.01) |
| *D06F 105/44* | (2020.01) |
| *D06F 105/58* | (2020.01) |
| *D06F 103/02* | (2020.01) |

(52) U.S. Cl.

CPC ..... *D06F 33/30* (2020.02); *D06F 34/14* (2020.02); *D06F 34/18* (2020.02); *D06F 34/28* (2020.02); *D06F 2103/02* (2020.02); *D06F 2103/32* (2020.02); *D06F 2103/34* (2020.02); *D06F 2105/44* (2020.02); *D06F 2105/58* (2020.02); *D06F 2105/60* (2020.02)

(58) Field of Classification Search

None

See application file for complete search history.

(56) References Cited

U.S. PATENT DOCUMENTS

2011/0041260 A1* 2/2011 Balinski ..... D06F 58/38 8/159
2015/0167222 A1* 6/2015 Hwang ..... D06F 34/20 68/12.02

FOREIGN PATENT DOCUMENTS

EP 3 252 199 A1 12/2017
KR 10-2004-0045118 6/2004

OTHER PUBLICATIONS

Extended European Search Report dated Dec. 3, 2020 issued in Application 20192307.5.

* cited by examiner

*Primary Examiner* — Cristi J Tate-Sims
(74) *Attorney, Agent, or Firm* — KED & Associates LLP

(57) ABSTRACT

A laundry treating apparatus may include a main body, a door, a driver, a water supplier, a drain, an internal sensor, a controller, and a display. The internal sensor may measure at least one factor from among a temperature, a humidity, and a contamination degree inside the washing tub. The controller controls operations of the driver, the water supplier, and the drain, and receives input of the at least one factor measured by the internal sensor to derive a recommended take-out time of washed laundry. The display displays the recommended take-out time derived by the controller.

15 Claims, 9 Drawing Sheets

LAUNDRY TREATING APPARATUS AND SANITATION MANAGING METHOD FOR LAUNDRY USING THE SAME

CROSS-REFERENCE TO RELATED APPLICATION

This present application claims the benefit of priority to Korean Patent Application No. 10-2019-0116982, entitled "LAUNDRY TREATING APPARATUS AND SANITATION MANAGING METHOD FOR LAUNDRY USING THE SAME", filed in Korea on Sep. 23, 2019, in the Korean Intellectual Property Office, the entire disclosure of which is incorporated herein by reference.

BACKGROUND

1. Field

The present disclosure relates to a laundry treating apparatus and a sanitation managing method for laundry using the same and, more particularly, to a laundry treating apparatus configured to estimate when washed laundry that has not been taken out from a washing tub after a laundry cycle is completed will start to become contaminated and display the estimated time to a user, and a sanitation managing method for laundry using the same.

2. Background

Clothes require various management processes. For example, clothes are required to be washed, dried, stored, and ironed. For such management, there are various types of clothes treating apparatuses for washing, drying, storing, and ironing clothes. In addition, there are clothes treating apparatuses capable of performing all of the washing, drying, storing, and ironing of clothes.

Clothes treating apparatuses for washing clothes can be divided into two types: a drum type; and a pulsator type or an agitator type. In the drum-type washing machine, a washing tub having a cylindrical shape is horizontally disposed with an opening thereof facing forwards. In the pulsator-type washing machine, a washing tub is vertically disposed such that an opening of the washing tub faces upwards, and a pulsator formed in a disk shape is provided in the bottom surface of the washing tub. As the pulsator rotates, a changing current of water is created to perform laundry. In the agitator-type washing machine, a washing tub is vertically disposed such that an opening thereof faces upwards, and an agitator having a bar shape is provided within the washing tub. A current of water is created by rotation of the agitator.

The pulsator-type washing machine and the agitator-type washing machine perform a wash cycle, a rinse cycle, and a spin-dry cycle. The wash cycle and the rinse cycle are performed with the washing tub having water therein. The wash cycle and the rinse cycle are performed in the following order: water is supplied into the washing tub; the washing tub is operated; and the water is drained from the washing tub. In the spin-dry cycle, water is separated from the laundry by a centrifugal force generated as the washing tub rotates in one direction, in a state in which water can be drained.

The laundry that has gone through all of the wash cycle, the rinse cycle, and the spin-dry cycle may be left in the washing tub until the user takes out the washed laundry from the washing tub. However, the laundry that is left in the washing tub after a laundry cycle is completed may easily become contaminated because the washed laundry contains moisture and the door of the apparatus remains closed. When the washed laundry becomes contaminated, the washed laundry may give off a bad smell, and mold may develop in the washed laundry. The washed laundry may become contaminated when the washed laundry is left in the washing tub for a long time after a laundry cycle is completed, but the time the washed laundry starts to become contaminated may vary depending on the surrounding environment.

Korean Patent Application Publication No. 10-2004-0045118 (hereinafter referred to as "related art"), the subject matter of which is incorporated by reference, discloses a device for detecting the contamination degree for cleaning a tub in a washing machine and a method for cleaning a tub by using the same. The related art may be characterized in that a small amount of water is supplied into the tub before a laundry process is started or after a laundry cycle is completed, the water is stirred in the tub for a predetermined period of time, and then the turbidity of the water is measured, such that the contamination degree of an inner tub and/or an outer tub is detected. In the related art, cleaning of the tub is performed on the basis of the detected contamination degree in the tub, to thereby manage hygiene inside the tub. However, the related art has a limitation in that the washed laundry may not be prevented from becoming contaminated when the washed laundry is left in the washing tub after a laundry cycle is completed. In addition, the precise time the washed laundry in the tub starts to become contaminated is not disclosed in the related art. Accordingly, in the related art, it may be best for the user to take out the washed laundry from the tub as early as possible after a laundry cycle is completed.

The above-described background technology is technical information that the inventor has held for derivation of the present disclosure or that the inventor acquired in the process of deriving the present disclosure. Therefore, the above-described background technology cannot be regarded as known technology open to the general public prior to the filing of the present application.

BRIEF DESCRIPTION OF THE DRAWINGS

Arrangements and embodiments may be described in detail with reference to the following drawings in which like reference numerals refer to like elements and wherein.

DETAILED DESCRIPTION

Figure 1:
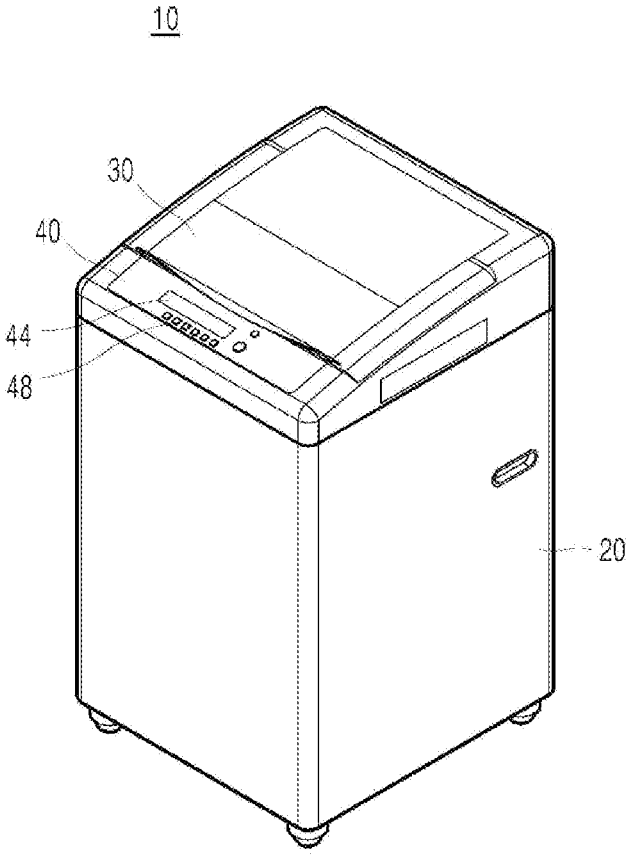
FIG. 1 is a perspective view of a pulsator-type laundry treating apparatus.

Advantages and features of the present disclosure and methods for achieving them will become apparent from the descriptions of aspects herein below with reference to the accompanying drawings. However, the present disclosure is not limited to the aspects disclosed herein but may be implemented in various different forms. The aspects are provided to make the description of the present disclosure thorough and to fully convey the scope of the present disclosure to those skilled in the art. It is to be noted that the scope of the present disclosure is defined only by the claims.

Embodiments of the present disclosure will be described in more detail referring to the attached drawings. Like reference numerals will be given to like parts throughout the detailed description of the embodiments.

Figure 2:
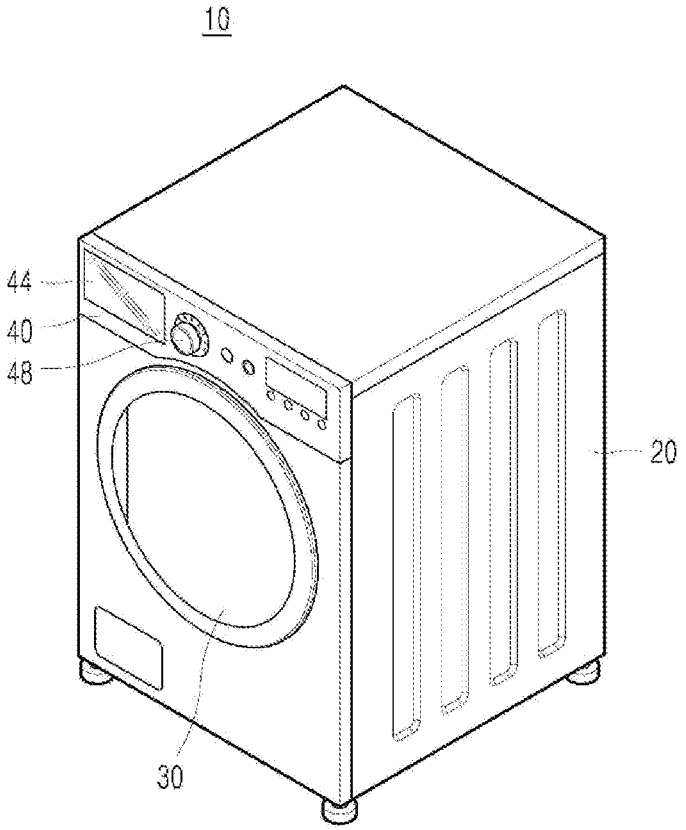
FIG. 2 is a perspective view of a drum-type laundry treating apparatus.

FIG. 1 is a perspective view of a pulsator-type laundry treating apparatus 10. FIG. 2 is a perspective view of a drum-type laundry treating apparatus 10. As shown in FIG. 1, the laundry treating apparatus 10 according to an embodiment of the present disclosure may be applied to a pulsator-type laundry treating apparatus 10 in which a washing tub is vertically installed with an opening thereof facing upwards and the washing tub rotates, or to an agitator-type laundry treating apparatus 10 in which a washing tub is vertically installed with an opening thereof facing upwards and an agitator provided in the washing tub rotates. Alternatively, as shown in FIG. 2, the laundry treating apparatus 10 according to an embodiment of the present disclosure may be applied to a drum-type laundry treating apparatus in which a washing tub is lying with an opening thereof facing forwards, and in which a laundry entrance through which laundry is inserted may be formed to face forwards.

As shown in FIGS. 1 and 2, the laundry treating apparatus 10 according to an embodiment of the present disclosure may include a main body 20, a door 30, and a control panel 40. The main body 20 may include a receiving space therein. A washing tub may be installed in the receiving space in the main body 20. The door 30 may be coupled to the main body 20 at one side surface or a top surface of the main body 20.

The door 30 may open or close the laundry entrance of the washing tub received in the main boy 20. The laundry entrance of the washing tub may be an entrance through which laundry is inserted into an inner space of the washing tub or is taken out from the inner space.

The control panel 40 may be installed on an outer surface of the main body 20 or the door 30. The control panel 40 may include a manipulation interface 48 capable of receiving a predetermined signal from a user. The manipulation interface 48 may include a button pressed by the user, and may be implemented in various forms including, for example, a touch type, a dial type, etc. The control panel 40 may include a display 42. The display 42 may display information related to the laundry treating apparatus 10. The display 42 may include a video output interface 44 and/or a sound output interface 46. The video output interface 44 may output video information. The sound output interface 46 may output sound information.

Figure 3:
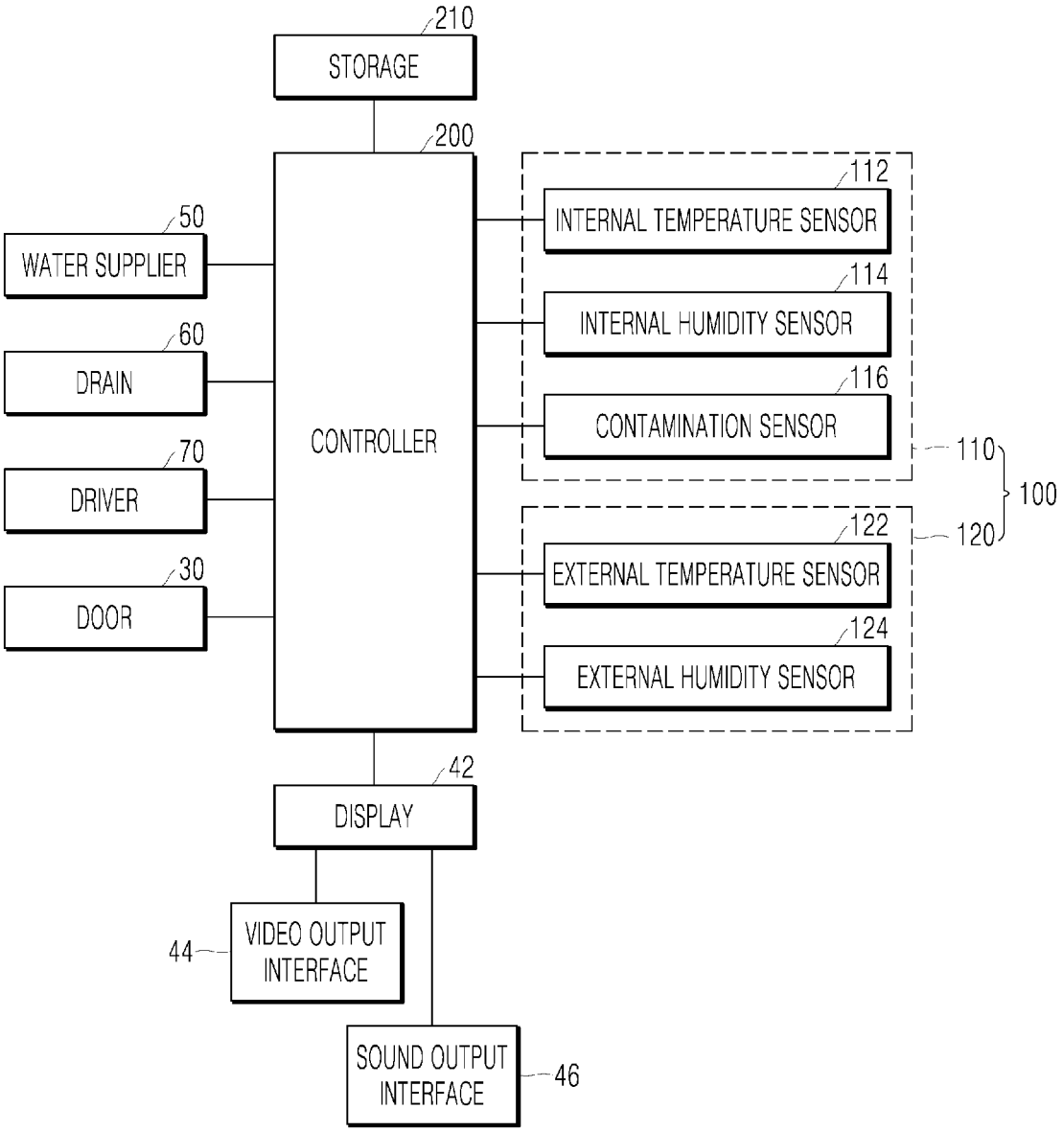
FIG. 3 is a block diagram illustrating a laundry treating apparatus according to an embodiment of the present disclosure.

FIG. 3 is a block diagram illustrating the laundry treating apparatus 10 according to an embodiment of the present disclosure. As shown in FIG. 3, the laundry treating apparatus 10 may further include a water supplier 50, a drain 60, a driver 70 (or driver device), a sensor 100 (or sensor device), and a controller 200.

The water supplier 50 may be connected to an external water tap, and may supply, to the washing tub, wash water supplied from the water tap. The water supplier 50 may supply water or stop supplying water according to a control of the controller 200.

The drain 60 may drain wash water in the washing tub to the outside of the washing tub. The drain 60 may be connected to a lower portion of the washing tub to move the wash water in the washing tub to the outside of the main body 20. The drain 60 may further include a drain pump for facilitating drainage. The drain 60 may drain water or stop draining water according to a control of the controller 200.

The driver 70 may be installed within the main body 20. The driver 70 may be disposed in a lower portion or at one side of the washing tub, and may be supplied with a power source to convert electric energy to kinetic energy. The converted kinetic energy may be a rotational force and may rotate the washing tub in at least one direction. The driver 70 may generate a rotational force according to a control of the controller 200, and may rotate the washing tub or stop rotating the washing tub.

The sensor 100 may include an internal sensor 110 and an external sensor 120. The internal sensor 110 may be provided within the main body 20 and sense conditions within the washing tub. Specifically, the internal sensor 110 may include an internal temperature sensor 112, an internal humidity sensor 114, and a contamination sensor 116. The internal temperature sensor 112 may measure a temperature inside the washing tub. The internal humidity sensor 114 may measure a humidity inside the washing tub. The contamination sensor 116 may measure a contamination degree inside the washing tub.

The contamination sensor 116 may be provided in a portion at which the washing tub and the drain 60 are connected to each other, and may sense the turbidity of the wash water that is discharged from the washing tub to measure the contamination degree inside the washing tub. The contamination sensor 116 may be provided as a sensor for measuring an air quality inside the washing tub, and may be implemented through various sensors capable of measuring the contamination degree inside the washing tub according to embodiments of the present disclosure.

The external sensor 120 may include an external temperature sensor 122 and an external humidity sensor 124. The external temperature sensor 122 and the external humidity sensor 124 may measure, respectively, a temperature and a humidity outside the main body 20.

Each of the internal sensor 110 and the external sensor 120 included in the sensor 100 may transmit measured data to the controller 200.

The controller 200 may be a central processing device, and may download a series of data or programs from a storage 210 (or memory) included in the controller 200 (or external to the controller) and execute the downloaded data or programs. The controller 200 may include any types of devices capable of processing data, such as a processor.

Processor may, for example, refer to a data processing device embedded in hardware, having a physically structured circuit to execute functions expressed as an instruction or code included in a program. Examples of the data processing device embedded in hardware may include a microprocessor, a central processor (CPU), a processor core, a multiprocessor, an application-specific integrated circuit (ASIC), and a field programmable gate array (FPGA), but the scope of the present disclosure is not limited thereto.

The controller 200 may control operations of the water supplier 50, the drain 60, and the driver 70, as described above. The controller 200 may be involved in opening and closing the door 30. The controller 200 may automatically open the door 30.

The storage 210 may be included in the controller 200, and programs and data for operating the laundry processing apparatus 10 may be stored in the storage 210. The programs and data stored in the storage 210 may be executed or used for calculation by the controller 200. The storage 210 may store information on a time taken for washed laundry to become contaminated depending on factors such as the temperature, the humidity, and the contamination degree inside the washing tub, and the temperature and the humidity outside the washing tub. That is, the storage 210 may store information based on experimental data regarding the time taken for washed laundry in the washing tub to become contaminated, obtained by experimentation in various conditions in which the temperature and the humidity inside and outside the washing tub and the contamination degree inside the washing tub are changed. The stored information may be used as a reference value, and the data measured through the sensor 100 may be used to derive how much time it will take for the washed laundry in the washing tub to become contaminated.

The controller 200 may compare the data measured through the sensor 100 with the reference value stored in the storage 210, and may calculate, on the basis of the reference value, a recommended take-out time, which is an estimated time during which the washed laundry can be left in the washing tub without contamination occurring. The recommended take-out time may be an estimated time during which the washed laundry left in the washing tub after a laundry cycle is completed may remain clean without contamination occurring.

The controller 200 may display the calculated recommended take-out time on the display 42. The display 42 may output, on the video output interface 44, a remaining time until expiration of the recommended take-out time. The sound output interface 46 (or sound output device) may output a sound signal that notifies the user of the recommended take-out time.

Figure 4:
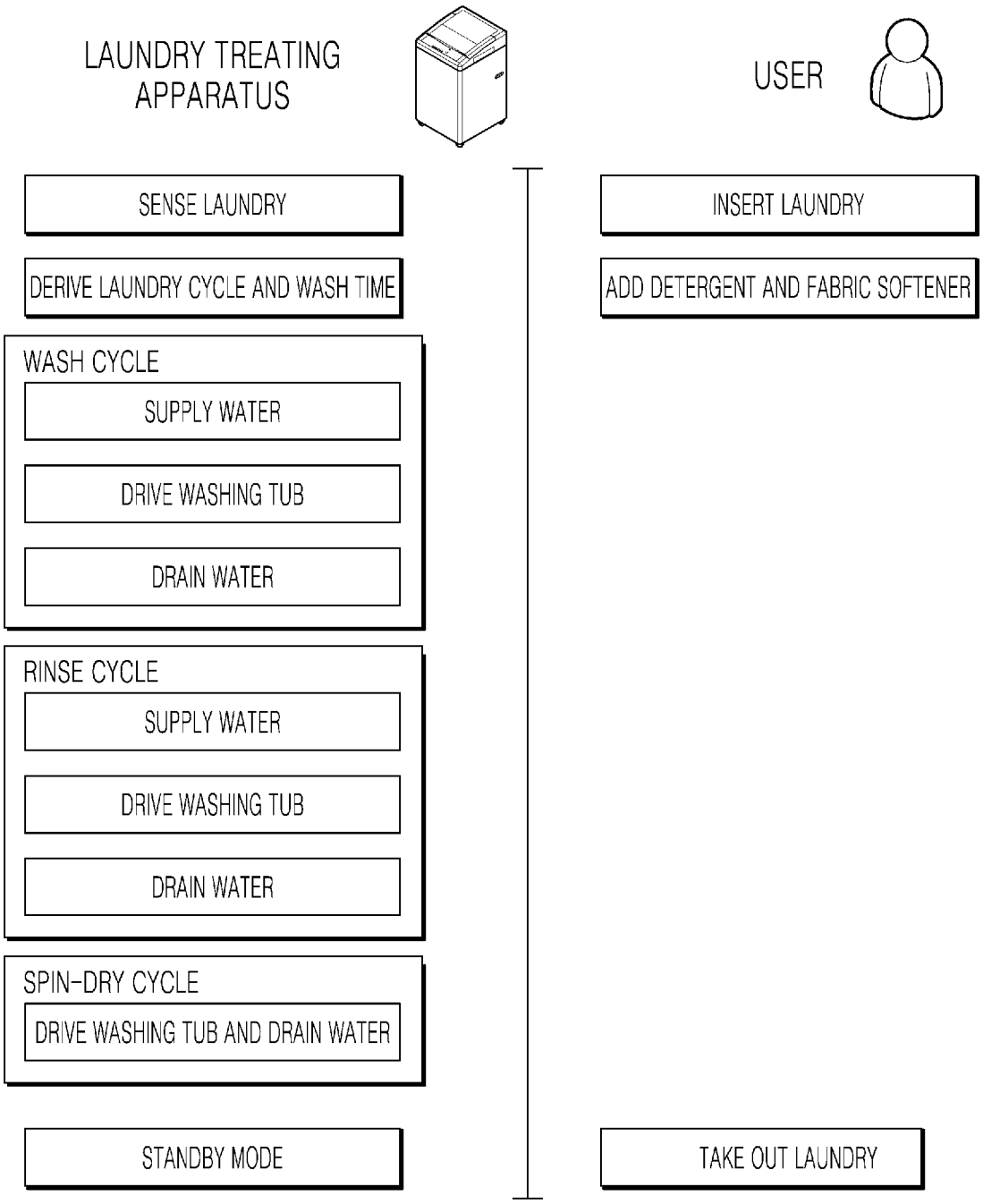
FIG. 4 is a block diagram illustrating a process in which the laundry treating apparatus performs laundry.

FIG. 4 is a block diagram illustrating a process of the laundry treating apparatus 10. As shown in FIG. 4, the laundry treating apparatus 10 may sense the amount of laundry that is inserted into the washing tub by the user. The amount of the laundry may be measured using a torque applied to the driver 70 when the washing tub is driven.

On the basis of the measured amount of the laundry, the laundry treating apparatus 10 may derive the amount of wash water to be supplied, laundry cycles to be performed, and an estimated wash time. In response to an input of an operation command by the user through the manipulation interface 48, the laundry treating apparatus 10 may perform, at least once, a wash cycle in which water is supplied, the driver 70 is driven, and water is drained.

After the wash cycle is completed, the laundry treating apparatus 10 may perform, at least once, a rinse cycle in which water is supplied, the driver 70 is driven, and water is drained. After the rinse cycle is completed, a spin-dry cycle may be performed in which the driver 70 is driven and water is drained.

The laundry treating apparatus may perform a series of cycles as described above, and when the spin-dry cycle is completed after a predetermined time, the laundry treating apparatus 10 may output a laundry completion signal at the display 42 and may be switched to a standby state. If the user does not take out the washed laundry from the washing tub right away, the washed laundry left in the washing tub may become contaminated due to environmental factors such as the temperature, the humidity, and microorganisms inside the washing tub.

Figure 5:
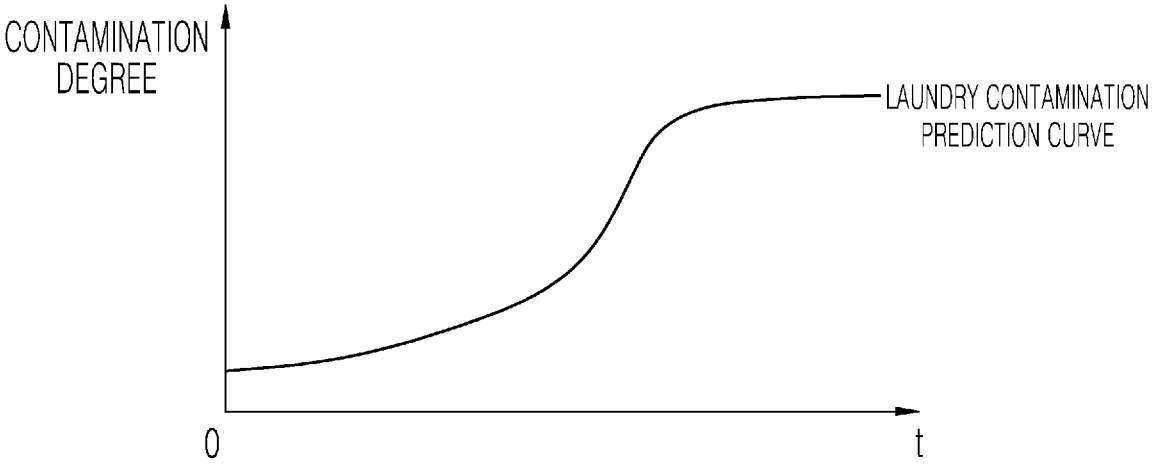
FIG. 5 is a graph illustrating the contamination degree over time of washed laundry that is left in a washing tub after a laundry cycle is completed.
Figure 6:
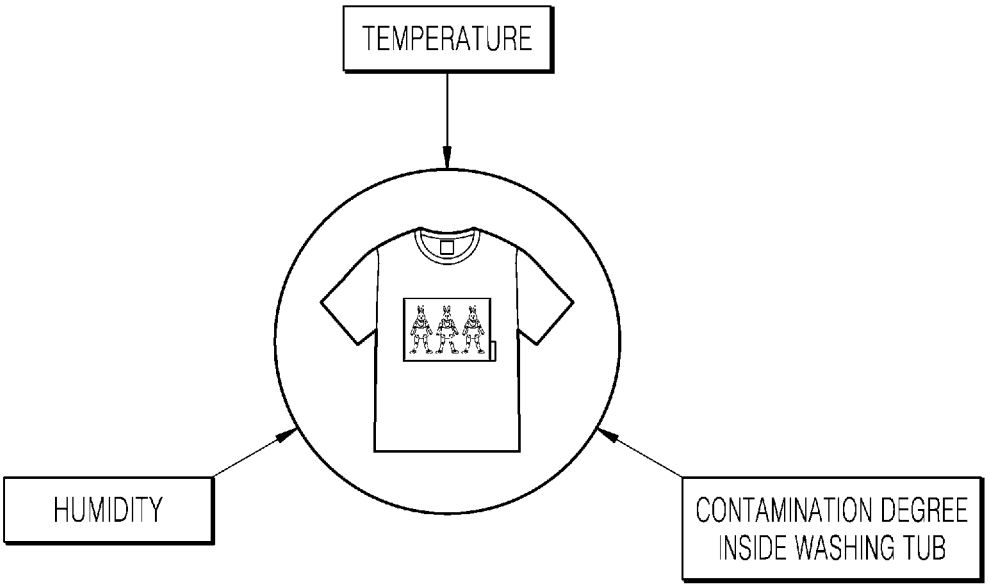
FIG. 6 is a block diagram illustrating factors involved in the contamination of the washed laundry that is left in the washing tub after a laundry cycle is completed.

FIG. 5 is a graph illustrating the contamination degree over time of washed laundry that is left in a washing tub after a laundry cycle is completed. FIG. 6 is a block diagram illustrating factors involved in the contamination of the washed laundry that is left in the washing tub after a laundry cycle is completed. As shown in FIGS. 5 and 6, the washed laundry that is left in the washing tub after a laundry cycle is completed may be contaminated due to factors including the temperature, the humidity, and the contamination degree in the washing tub, and a rate at which the washed laundry becomes contaminated within the washing tub may vary depending on the temperature, the humidity, and the contamination degree in the washing tub.

The contamination degree of the washed laundry may be predicted as shown with a curve of the graph in FIG. 5. Depending on the contamination degree of the washed laundry, the washed laundry may give off a bad smell, and/or mold may develop in the washed laundry. From a contamination prediction curve in FIG. 5, a time from which the washed laundry gives off a bad smell, and/or from which mold develops in the washed laundry, may be approximately predicted.

Figure 7:
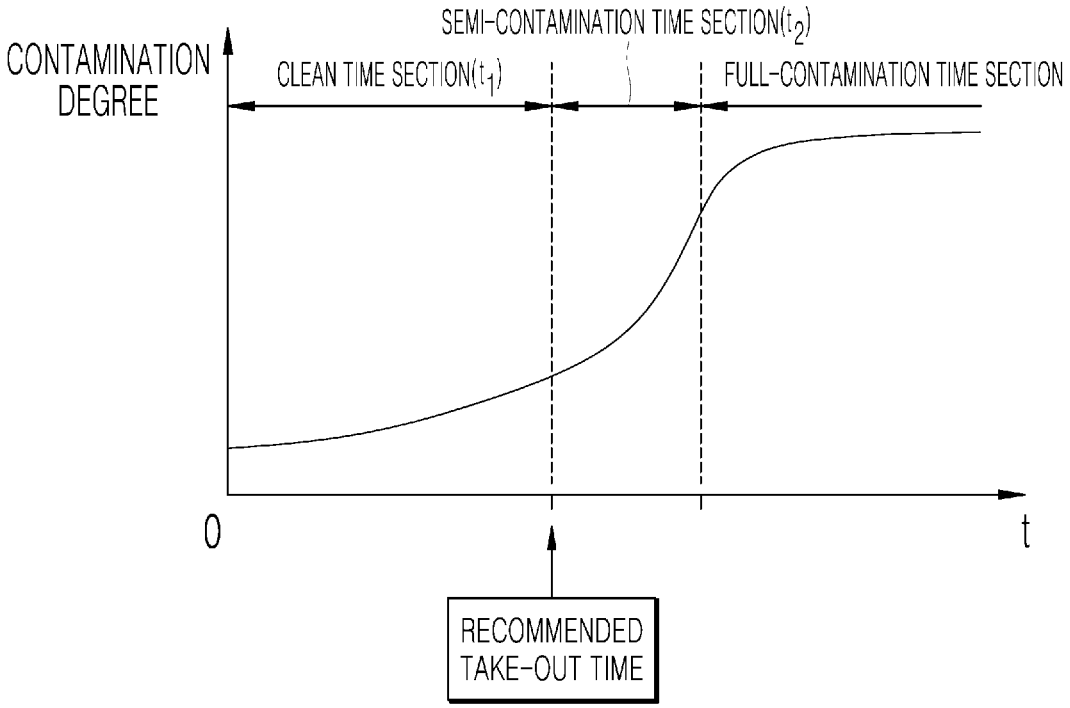
FIGS. 7 and 8 are graphs illustrating criteria for determining a recommended take-out time and times to perform an additional rinse cycle and an additional wash cycle in the laundry treating apparatus.
Figure 8:
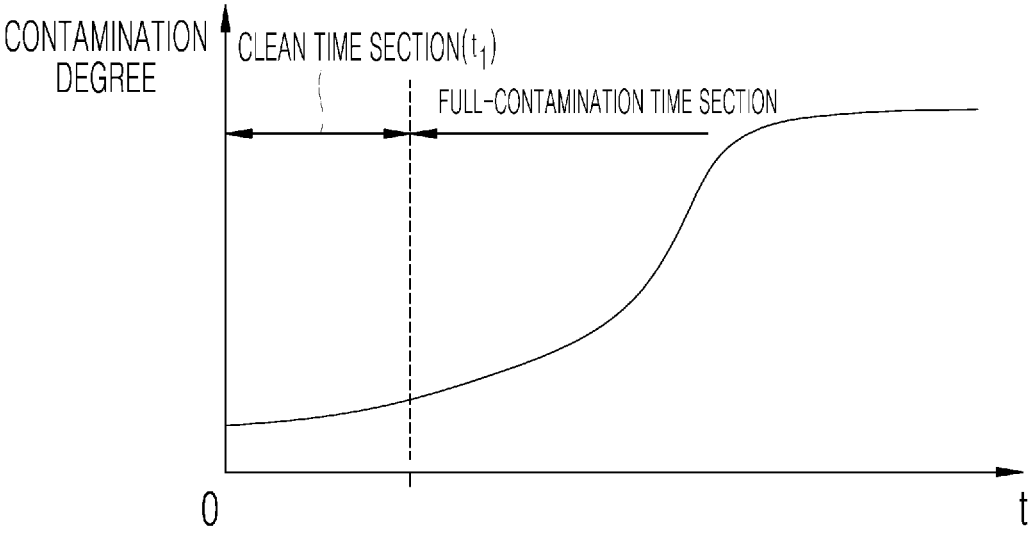

FIGS. 7 and 8 are graphs illustrating criteria for determining a recommended take-out time and times to perform an additional rinse cycle and an additional wash cycle in the laundry treating apparatus 10. As shown in FIG. 7, the laundry treating apparatus 10 may set a clean time section during which the washed laundry left in the washing tub does not become contaminated, a semi-contamination time section during which the washed laundry becomes contaminated to some degree and thus requires an additional rinse cycle, and a full-contamination time section during which the washed laundry becomes contaminated to a high degree and thus requires an additional wash cycle. These time sections may be stored in advance in the storage 210.

Alternatively, depending on embodiments of the present disclosure, the laundry treating apparatus 10 may apply a stricter standard for determining contamination of the washed laundry, such that the time sections are divided into a clean time section and a full-contamination time section as shown in FIG. 8, and the laundry treating apparatus 10 may store the time sections in the storage 210.

As described above, the time sections may be divided into the clean time section, the semi-contamination time section, and the full-contamination time section, as shown in FIGS. 7 and 8, on the basis of the experimental data obtained under various, conditions as described above, and may be stored in the storage 210.

Figure 9:
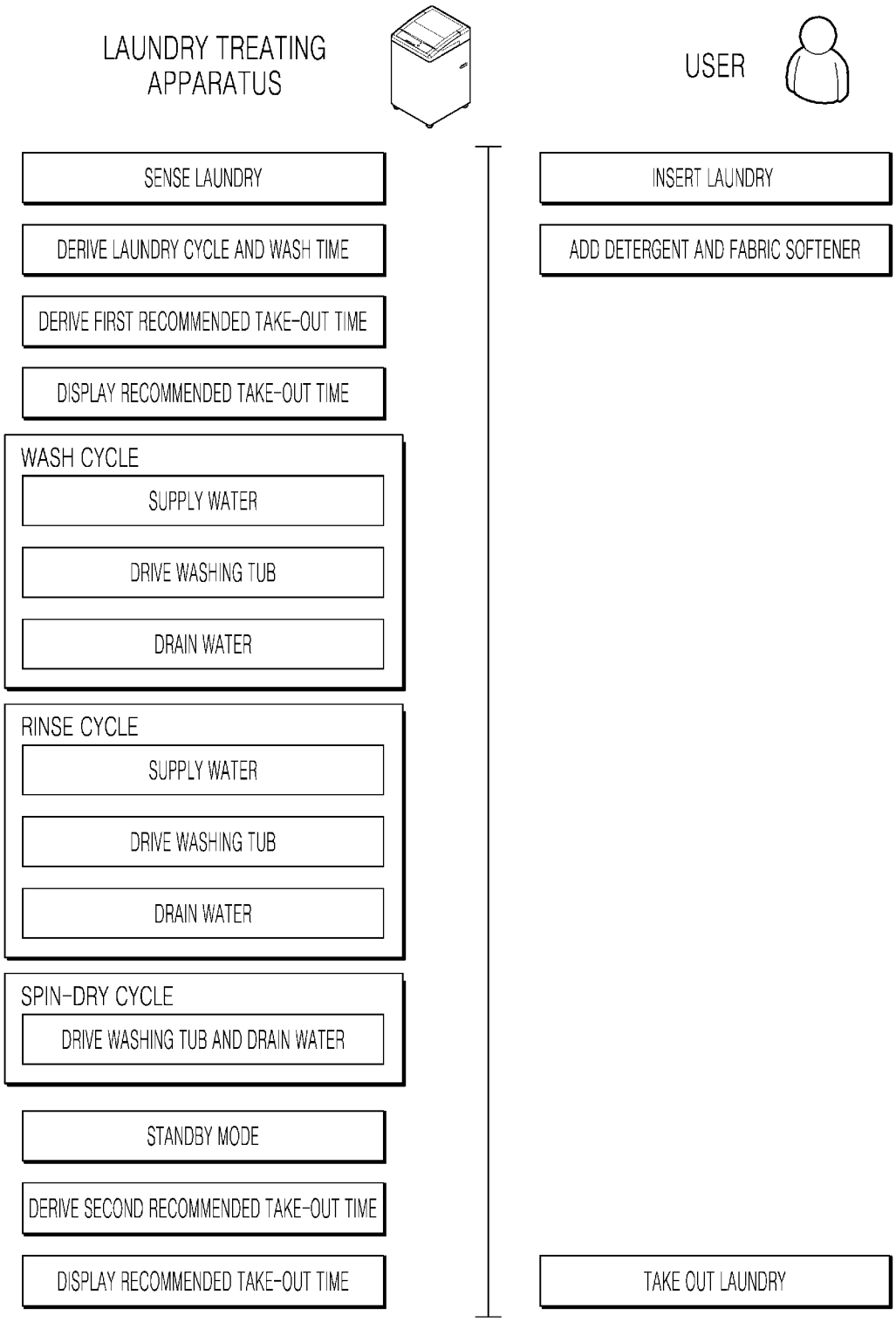
FIG. 9 is a block diagram illustrating a process in which the laundry treating apparatus performs laundry, and calculates and displays a recommended take-out time.

FIG. 9 is a block diagram illustrating a process in which the laundry treating apparatus 10 according to an embodiment of the present disclosure performs laundry, and calculates and displays a recommended take-out time. As shown in FIG. 9, in response to an initial insertion of laundry into the washing tub by the user, the laundry treating apparatus 10 may sense the amount of the inserted laundry and, at the same time, derive a first recommended take-out time. The derivation of the first recommended take-out time may be performed by sensing the temperature and the humidity inside and outside the washing tub and the contamination degree in the washing tub before the laundry cycle is started.

The derived first recommended take-out time may be added up with the estimated wash time and then outputted to the user through the display 42. For example, if an estimated time for the entire laundry process including the wash cycle, the rinse cycle, and the spin-dry cycle is 50 minutes, and the first recommended take-out time is 300 minutes, the display 42 may display, to the user, that the recommended take-out time is 350 minutes, before the user manipulates the manipulation interface 48 to start the laundry process. The user may then check the recommended take-out time and plan when to take out the washed laundry.

When the washing tub is switched to the standby state with the washed laundry left in the washing tub after the entire laundry process including the wash cycle, the rinse cycle, and the spin-dry cycle is completed, a second recommended take-out time may be calculated by the controller 200. The second recommended take-out time may be calculated by comparing the reference value stored in the storage 210 with the factors including the temperature, the humidity, and the contamination degree inside the washing tub and the temperature and the humidity outside the washing tub measured after a laundry cycle is completed. The calculated second recommended take-out time may be displayed through the display 42.

The controller 200 may be connected to a series of networks to perform communication, and may transmit laundry information including the calculated recommended take-out time to a mobile terminal that is predetermined by the user. The networks may include a wired network such as a local area network (LAN), a wide area network (WAN), a metropolitan area network (MAN), and an integrated service digital network (ISDN), or a wireless network such as a wireless LAN, a CDMA, Bluetooth®, and satellite communication, but the present disclosure is not limited thereto. The networks may transmit and receive information by using short distance communication and/or long distance communication. The short distance communication may include Bluetooth®, radio frequency identification (RFID), infrared data association (IrDA), ultra-wideband (UWB), ZigBee, and wireless fidelity (Wi-Fi) technologies, and the long distance communication may include code division multiple access (CDMA), frequency division multiple access (FDMA), time division multiple access (TDMA), orthogonal frequency division multiple access (OFDMA), and single carrier frequency division multiple access (SC-FDMA). The networks may include connections of network elements such as a hub, a bridge, a router, a switch, and a gateway, and the controller 200 may further include a transceiver for configuring a network.

Figure 10:
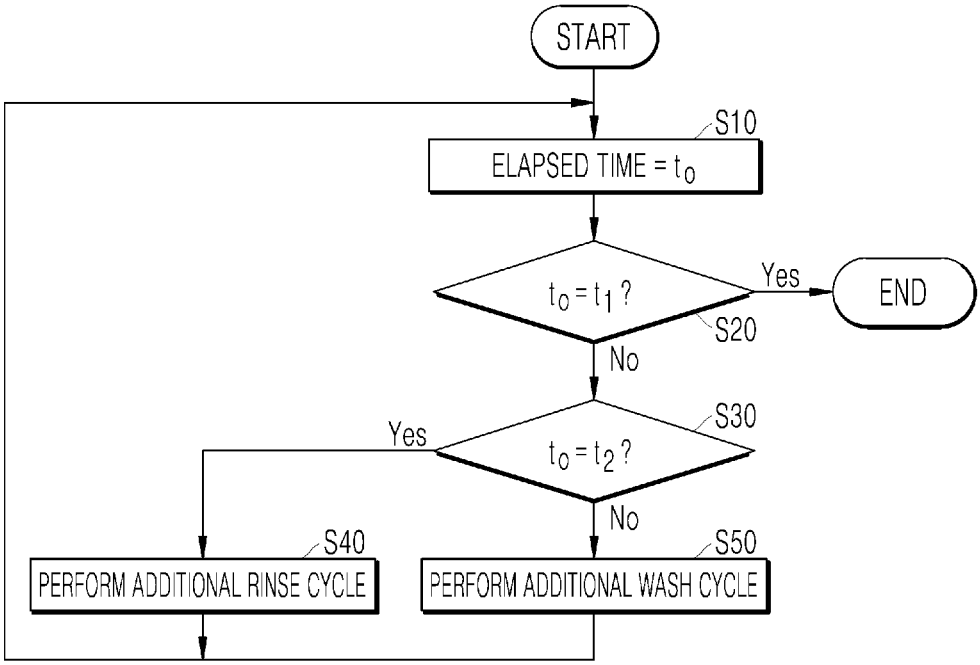
FIG. 10 is a flow chart illustrating a process of performing an additional rinse cycle and an additional wash cycle in a sanitation managing method for laundry according to an embodiment of the present disclosure.

FIG. 10 is a flow chart illustrating a process of performing an additional rinse cycle and an additional wash cycle in a sanitation managing method for laundry according to an embodiment of the present disclosure. As shown in FIG. 10, in the laundry treating apparatus 10, a time elapsed after a laundry cycle is completed will be referred to as to, the clean time section during which the user may take out washed laundry without contamination occurring will be referred to as $t_1$, and the semi-contamination time section will be referred to as $t_2$, wherein the end of the clean time section is the recommended take-out time.

$t_0$ may be measured (S10) and then compared to $t_1$ (S20), and when to falls within $t_1$, the controller 200 may display a remaining time until an expiration of the recommended take-out time through the display 42. When to exceeds $t_1$, to may be compared to $t_2$ (S30), and when to falls within $t_2$, an additional rinse cycle may be performed (S40). When to exceeds $t_2$, the controller 200 may perform an additional wash cycle (S50).

The additional rinse cycle may include a rinse cycle and a spin-dry cycle, and the additional wash cycle may include a wash cycle, a rinse cycle, and a spin-dry cycle.

Figure 11:
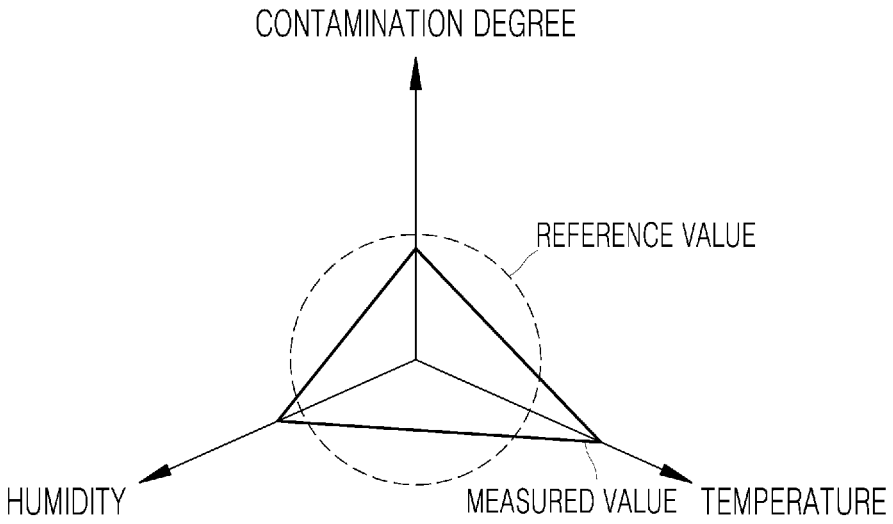
FIGS. 11 and 12 are graphs illustrating criteria for determining whether to perform an additional rinse cycle and an additional wash cycle in the sanitation managing method for laundry according to an embodiment of the present disclosure.
Figure 12:
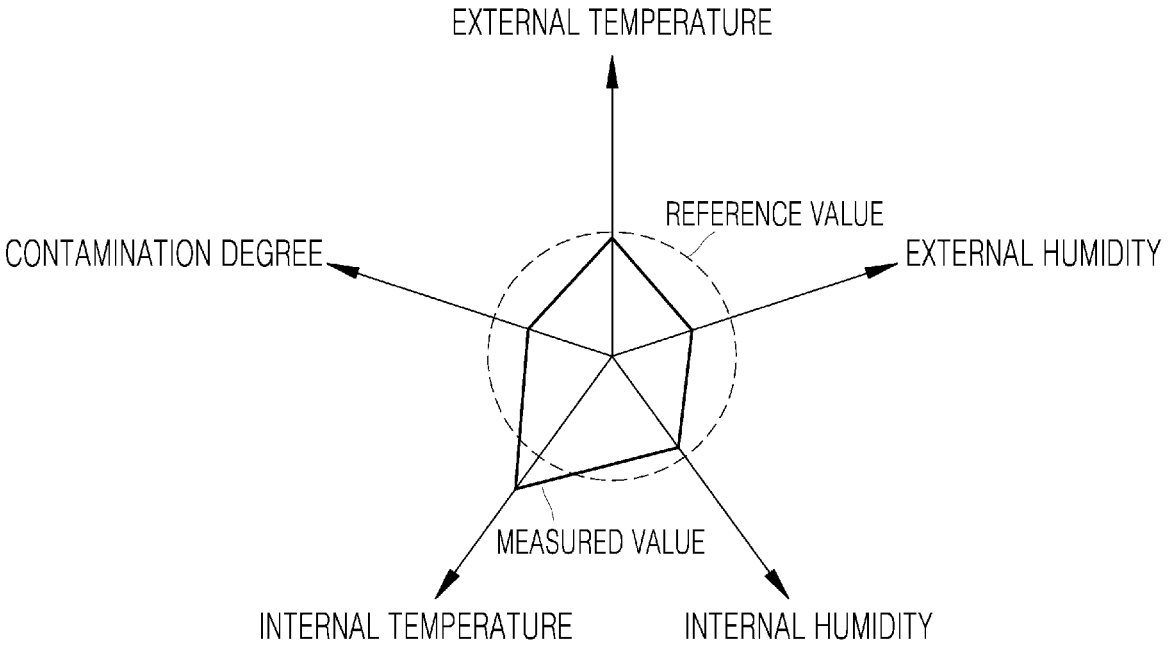

FIGS. 11 and 12 are graphs illustrating criteria for determining whether to perform an additional rinse cycle and an additional wash cycle in the sanitation managing method for laundry according to an embodiment of the present disclosure. The laundry treating apparatus 10 may derive the recommended take-out time on the basis of three factors of the temperature, the humidity, and the contamination degree inside the washing tub, or may derive the recommended take-out time on the basis of five factors of the temperature, the humidity, and the contamination degree inside the washing tub, and the temperature and the humidity outside the main body 20.

The controller 200 may derive the recommended take-out time on the basis of the measured factors and the reference value stored in the storage 210. For example, referring to FIGS. 11 and 12, when a measured value of each factor is outside the circle drawn with the broken line, which is the reference value, it may be determined that the washed laundry left in the washing tub is contaminated, and the time when the washed laundry starts to become contaminated may be calculated on the basis of the reference values that are stored in the storage 210 in advance as experimental data.

The sanitation managing method for laundry using the laundry treating apparatus 10 will be described. The sanitation managing method for laundry may include a first step in which at least one of the temperature, the humidity, or the contamination degree inside the laundry treating apparatus 10 that has completed a laundry cycle is measured. In the first step, the temperature and the humidity outside the laundry treating apparatus 10 may be additionally measured to be used as factors.

The sanitation managing method for laundry may include second step in which the recommended take-out time, which is an estimated time during which the user may take out the washed laundry without contamination occurring, is derived on the basis of at least one factor from among the temperature, the humidity, and the contamination degree inside the laundry treating apparatus 10, and the temperature and the humidity outside the laundry treating apparatus 10 that were measured in the first step. In the second step, the controller 200 may derive the recommended take-out time by comparing data measured through the sensor 100 with the reference value stored in the storage 210 as experimental data.

The sanitation managing method for laundry may include a third step in which the recommended take-out time derived in the second step is displayed on the display 42. The first through third steps may be repeatedly performed at predetermined time intervals.

The sanitation managing method for laundry may further include a fourth step in which an additional rinse cycle or an additional wash cycle that is required to be performed is displayed to the user through the display 42. Circumstances that require an additional rinse cycle or an additional wash cycle were described in detail above when the laundry treating apparatus 10 according to an embodiment of the present disclosure was described.

In the fourth step, when the recommended take-out time expires, an additional rinse cycle or an additional wash cycle may be automatically performed. Alternatively, the door 30 may be opened at a preset time before the recommended take-out time expires. Furthermore, in the fourth step, the recommended take-out time may be transmitted to a mobile terminal that is predetermined by the user so as to be displayed to the user.

An aspect of the present disclosure is directed to overcoming a limitation of the related art in which it is not possible to accurately identify a time until which washed laundry that is left in the washing tub after a laundry cycle is completed can be taken out without contamination occurring. Another aspect of the present disclosure is directed to overcoming a limitation of the related art in which the washed laundry can easily become contaminated when the user does not pay attention to the laundry. Yet another aspect of the present disclosure is directed to overcoming a limitation of the related art in which it is subjectively determined by the user whether the washed laundry in the washing tub has been contaminated, and thus a user who is not accustomed to doing laundry may take out the washed laundry from the washing tub after the washed laundry has become contaminated.

A laundry treating apparatus according to an embodiment of the present disclosure may include a main body, a door, a driver, a water supplier, a drain, an internal sensor, a controller, and a display.

The main body may include a washing tub therein. The door may be coupled to the main body to open or close a laundry entrance formed in the washing tub. The driver may be installed in the main body to operate the washing tub.

The water supplier may be installed in the main body to supply wash water to the washing tub. The drain may be installed in the main body to drain wash water received in the washing tub.

The internal sensor may measure at least one factor from among a temperature, a humidity, and a contamination degree inside the washing tub.

The controller may control operations of the driver, the water supplier, and the drain, and may receive input of the at least one factor measured by the internal sensor to derive a recommended take-out time of the washed laundry.

The display may display the recommended take-out time derived by the controller.

In the laundry treating apparatus according to an embodiment of the present disclosure, the display may include a video output interface and a sound output interface. The video output interface may output the recommended take-out time in the form of visual information. The sound output interface may output the recommended take-out time in the form of sound information.

In the laundry treating apparatus according to an embodiment of the present disclosure, the controller may include a storage. The storage may store information on a time taken for washed laundry to become contaminated depending on the temperature, the humidity, and the contamination degree inside the washing tub. The controller may calculate the recommended take-out time on the basis of the information stored in the storage.

The laundry treating apparatus according to an embodiment of the present disclosure may further include an external sensor configured to measure a temperature and a humidity outside the main body.

In the laundry treating apparatus according to an embodiment of the present disclosure, the controller may include a storage configured to store information on a time taken for washed laundry to become contaminated depending on the temperature, the humidity, and the contamination degree inside the washing tub, and the temperature and the humidity outside the main body. The controller may calculate the recommended take-out time on the basis of the information stored in the storage.

In the laundry treating apparatus according to an embodiment of the present disclosure, the controller may transmit the recommended take-out time to a predetermined mobile terminal.

In the laundry treating apparatus according to an embodiment of the present disclosure, the controller may control opening and closing of the door and may open the door when a laundry cycle is completed.

A sanitation managing method for laundry using a laundry treating apparatus according to an embodiment of the present disclosure may include a first step in which at least one of a temperature, a humidity, or a contamination degree inside a laundry treating apparatus that has completed a laundry cycle is measured, a second step in which a recommended take-out time, which is an estimated time during which the user may take out washed laundry without contamination occurring, is derived on the basis of the at least one of the temperature, the humidity, or the contamination degree inside the laundry treating apparatus that was measured in the first step, a third step in which the recommended take-out time is displayed to a user, and a fourth step in which, on the basis of the recommended take-out time, it may be displayed to the user that an additional rinse cycle or an additional wash cycle is required to be performed.

In the sanitation managing method for laundry according to an embodiment of the present disclosure, a temperature and a humidity outside the laundry treating apparatus may be further measured in the first step. In addition, in the second step, the recommended take-out time, which is the estimated time during which the user may take out the washed laundry without contamination occurring, may be derived on the basis of the temperature, the humidity, and the contamination degree inside the laundry treating apparatus, and the temperature and the humidity outside the laundry treating apparatus that are measured in the first step.

In the sanitation managing method for laundry according to an embodiment of the present disclosure, when the recommended take-out time expires in the fourth step, an additional rinse cycle may be automatically performed.

In the sanitation managing method for laundry according to an embodiment of the present disclosure, the first through third steps may be repeatedly performed at predetermined time intervals.

In the sanitation managing method for laundry according to an embodiment of the present disclosure, the recommended take-out time may be transmitted to a predetermined mobile terminal in the fourth step.

According to embodiments of the present disclosure, the time when the washed laundry will start to become contaminated may be calculated on the basis of conditions inside and outside the washing tub and then displayed to the user. Accordingly, the user may be accurately notified of a time until which the user may take out the washed laundry without contamination from the washing tub occurring.

According to embodiments of the present disclosure, as the controller opens the door before the recommended take-out time expires, the time during which the washed laundry can be taken out without contamination occurring may be extended.

According to embodiments of the present disclosure, as the user receives the recommended take-out time through a mobile terminal, the user may be notified that the washed laundry has been left in the washing tub.

According to embodiments of the present disclosure, when the recommended take-out time expires and thus it is highly likely that the washed laundry left in the washing tub has been contaminated, an additional rinse cycle or an additional wash cycle may be performed, such that washed laundry that has been contaminated is not taken out from the washing tub by the user.

The effects of the present disclosure are not limited to those mentioned above, and other effects not mentioned can be clearly understood by those skilled in the art from the following description.

The shapes, sizes, ratios, angles, the number of elements given in the drawings are merely exemplary, and thus, the present disclosure is not limited to the illustrated details. Like reference numerals designate like elements throughout the specification.

In relation to describing the present disclosure, when the detailed description of the relevant known technology is determined to unnecessarily obscure the gist of the present disclosure, the detailed description may be omitted.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

As used herein, the expressions "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" includes the following meanings: A alone; B alone; C alone; both A and B together; both A and C together; both B and C together; and all three of A, B, and C together. Further, these expressions are open-ended, unless expressly designated to the contrary by their combination with the term "consisting of:" For example, the expression "at least one of A, B, and C" may also include an nth member, where n is greater than 3, whereas the expression "at least one selected from the group consisting of A, B, and C" does not.

Hereinbefore, embodiments of the present disclosure were described with reference to the drawings, but the present disclosure should not be construed as being limited to the embodiments and drawings set forth herein. It will be apparent to those skilled in the art that various other changes and modifications can be made without departing from the spirit and scope of the present disclosure. In addition, although not all actions or effects according to the configurations of the embodiments have been explicitly described, it is apparent that predictable actions or effects from the configurations should also be recognized as falling within the spirit and scope of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a main body to have a washing tub to be provided therein;

a door to couple to the main body, and to open or close a laundry entrance at the washing tub;

a driver disposed at the main body to move the washing tub;

a water supplier disposed at the main body to supply wash water to the washing tub;

a drain disposed at the main body to discharge the wash water from the washing tub;

an internal sensor configured to measure, from the washing tub, at least a first one of a temperature, a humidity, or a contamination degree;

a controller configured to control operations of the driver, the water supplier, and the drain, to receive information measured from the internal sensor, and to determine a recommended take-out time of washed laundry based on the received information; and a display configured to display information of the recommended take-out time.

2. The laundry treating apparatus of claim 1, wherein the display comprises:

a video output interface configured to display the information of the recommended take-out time; and a sound output interface configured to output audio relating to the information of the recommended take-out time.

3. The laundry treating apparatus of claim 1, wherein the controller comprises a storage configured to store information regarding a time for washed laundry to become contaminated depending on at least one of the temperature, the humidity, or the contamination degree inside the washing tub, and wherein the controller is to determine the information of the recommended take-out time based on the stored information.

4. The laundry treating apparatus of claim 1, further comprising an external sensor configured to measure at least a second one of a temperature outside the main body or a humidity outside the main body.

5. The laundry treating apparatus of claim 4, wherein the controller comprises a storage configured to store information regarding a time for washed laundry to become contaminated depending on the at least first one of the temperature, the humidity, or the contamination degree inside the washing tub, and the at least second one of the temperature or the humidity outside the main body, and wherein the controller is to determine the information of the recommended take-out time based on the stored information.

6. The laundry treating apparatus of claim 1, wherein the controller is configured to control transmitting the information of the recommended take-out time from the laundry treating apparatus to a predetermined terminal.

7. The laundry treating apparatus of claim 1, wherein the controller is configured to control opening and closing of the door, and to open the door when a laundry cycle is completed.

8. A laundry treating apparatus, comprising:

a washing tub;

a body to surround the washing tub;

a display to display information;

a door to open or close an entrance of the washing tub;

a driver to move the washing tub;

an internal sensor at the washing tub, and configured to sense, after completion of a laundry cycle, at least one of a temperature, a humidity, or a contamination degree;

a controller configured to:

control at least the driver, receive first sensed information from the internal sensor, compare the first sensed information and stored reference information relating to contamination of laundry, determine time information relating to removing laundry from the washing tub based on the comparing of the first sensed information and the stored reference information, and control the display to display the time information.

9. The laundry treating apparatus of claim 8, comprising a storage configured to store information regarding a time for washed laundry to become contaminated depending on the first sensed information from the internal sensor, and wherein the controller is to determine the time information based on the stored information.

10. The laundry treating apparatus of claim 8, further comprising an external sensor configured to sense at least one of a temperature outside the laundry treating apparatus or a humidity outside the laundry treating apparatus.

11. The laundry treating apparatus of claim 10, wherein the controller is configured to:

receive second sensed information from the external sensor, and compare the second sensed information and stored reference information relating to contamination of laundry, wherein the determining of the time information relating to removing laundry from the washing tub is further based on the comparing of the second sensed information and the stored reference information.

12. The laundry treating apparatus of claim 11, comprising a storage configured to store information regarding a time for washed laundry to become contaminated depending on the first sensed information from the internal sensor, and the second sensed information from the external sensor, and wherein the controller is to determine the time information based on the stored information.

13. The laundry treating apparatus of claim 8, wherein the display comprises:

a video output interface configured to display the time information relating to removing laundry; and a sound output interface configured to output audio relating to the time information relating to removing laundry.

14. The laundry treating apparatus of claim 8, wherein the controller is configured to control transmitting the time information relating to removing laundry from the laundry treating apparatus to a predetermined terminal.

15. The laundry treating apparatus of claim 8, wherein the controller is configured to control opening and closing of the door, and to open the door when a laundry cycle is completed.

* * * * *